US005388834A

United States Patent [19]

Dawson

[11] Patent Number: 5,388,834

[45] Date of Patent: Feb. 14, 1995

[54] GOLF SWING TRAINING AID

[76] Inventor: Dennis Dawson, 4071 Hollow Pl., Moorpark, Calif. 93021

[21] Appl. No.: 121,935

[22] Filed: Sep. 15, 1993

[51] Int. Cl.[6] ..... A63B 69/36

[52] U.S. Cl. ..... 273/194 R; 273/81.2; 273/81.3; 273/81 D; 273/193 B

[58] Field of Search ..... 273/81 C, 81 D, 81.3, 273/77 R, 81.2, 193 R, 194 R, 193 B, 81.4

[56] References Cited

U.S. PATENT DOCUMENTS

| | | | |
|---|---|---|---|
| 4,754,978 | 7/1988 | Dworacek | 273/193 R |
| 4,819,944 | 4/1989 | Doane | 273/194 R X |
| 5,037,103 | 8/1991 | Williams et al. | 273/81.3 |
| 5,106,095 | 4/1992 | Pitkethly | 273/193 R X |

OTHER PUBLICATIONS

"Golf Gadgets"/ Bill Hogan, 1953 Tilden Press Book, Macmillan Publishing Co. 866 Third Ave., New York, N.Y. 10222 Collier Macmillan Canada, Inc. p. 41.

*Primary Examiner*—George J. Marlo
*Attorney, Agent, or Firm*—David O'Reilly

[57] ABSTRACT

A golf swing training aid comprised of a crossbar and a pair of golf grips attached to the outboard end of the crossbar. A socket in the crossbar is constructed to receive the shaft of a standard golf club. A hinged clamp with a thumbscrew allows the crossbar with the grips to be easily and quickly attached or detached from any standard golf club. The golf grips on the crossbar are about two inches shorter than the grips on the club to permit the club to be swung with the golf club grips or the outboard grips with the golf swing training aid attached. Optionally, a pointer can be attached to the training aid and the outboard golf grips can be foldable or detachable for storing the golf swing training aid in a golf bag.

18 Claims, 3 Drawing Sheets

10
12
14
16
17
18
19
20
22
24
26
4
5

GOLF SWING TRAINING AID

FIELD OF THE INVENTION

This invention relates to training aids for golfers and more particularly, relates to a golf swing training aid for attachment to a golfer's club.

BACKGROUND OF THE INVENTION

Golf has become increasing popular over the years which has spurred development of many devices to aid in training golfers. Some of these training aids are to strengthen muscles, while others are to train specific features of the golf swing. The problem with many of these devices is they only help in one area of the golf swing and do not help with other aspects. For example, some devices attach to a golf club to help position the hands on the grip, but don't help with the swing, position or set-up. Other devices help with the position of the club during the golf swing but don't help or provide any feedback of the proper position of the club during a swing. Further, none of them help with all clubs used when playing the game.

A popular method, used by instructors to teach beginning golfers the feel of the golf swing, is to use a bucket (with or without water) or a ball. The instructor has the student throw the ball in a sideways motion to get the feel of the arms swinging in unison and the turn of the body. This is very effective in teaching golfers the proper motion during the swing and give them the "feel" of the golf swing. However, the golfer must then translate this to the golf club itself which is difficult. It would be advantageous if this motion and positioning of the arms and body during the golf swing could be taught using the player's own golf clubs.

It is therefore one object of the present invention to be a golf swing training aid that is easily attached to a player's own clubs.

Yet another object of the present invention is to provide a golf swing training aid that can give a golfer the feel of the golf swing.

Still another object of the present invention is to provide a golf swing training aid that is capable of being attached to one's own clubs and can provide positive feedback of the proper position of the club during the swing.

Still another object of the present invention is to provide a golf swing training aid that may be attached to any of the golf clubs to train the golfer in hitting any of the various golf shots.

Still another object of the present invention is to provide a golf swing training aid that may be attached to a golf club that aids in teaching the player the proper grip.

Still another object of the present invention is to provide a golf swing training aid that is attached to a golfer's own club and can assist in providing proper alignment.

Yet another object of the present invention is to provide a golf swing training aid that allows a player to swing the club by switching back and forth from the attached golf swing training aid to the golf club grip.

Still another object of the present invention is to provide a golf swing training aid that clamps on the shaft of the player's own clubs and provides a pair of outboard grips that will allow the golfer to swing the club and obtain the feel of the golf swing.

BRIEF DESCRIPTION OF THE INVENTION

The purpose of the present invention is to provide a golf swing training aid which will teach nearly all aspects of the golf swing from the driver through the putter.

The golf swing training aid is comprised of a crossbar that is easily attached to the shaft of the golf club and has a pair of outboard grips that can be used to swing the club. The crossbar is attached to the shaft by a clamping arrangement at the center of the crossbar. The golf club shaft is positioned in the clamp and a captive thumbscrew is tightened down to securely clamp the player's own club in the golf swing training aid.

The grips, positioned on the outboard ends of the crossbar are substantially the same as grips used on ordinary golf clubs with the exception of being slightly shorter. Preferably, they are an inch or two shorter to allow a player to switch from a position holding the grips on the training aid to the grip on his own club so that a player may experience the feel of the proper grip and swing without having to change clubs.

The clamping arrangement allows the golf swing training aid crossbar to be attached at the lower end of the golf club grip so that the crossbar is substantially perpendicular to the face of the golf club. The golf club training aid assists the golfer by providing feedback about the proper positioning of the club during set-up and when swinging. The player grasps the outboard grips during set-up and with the crossbar, can visualize the alignment of the club face.

The position of the grips also will assist the player in properly positioning his hands on the grips. When the two outboard grips are placed in a player's hands, the player almost automatically, puts the palms of his hands in a the opposing relationship required for a proper golf grip. This gives the player the feel of the grip which can then be transferred to the golf club grip itself.

When swinging the club, the crossbar also provides feedback as to whether or not the swing has been properly executed. When a player begins his swing and takes it back approximately half way, the club head should be pointed substantially straight up in the air. With the golf swing training aid attached to the club head, the crossbar should then be substantially parallel to the ground. The player can look at the crossbar and visualize whether or not the club is in the proper position at this point.

As the swing progresses to the top of the swing, with the club over the head, the club head should now be pointing substantially downward. Again, the crossbar of the golf swing training aid should be parallel to the ground so the player may determine, by turning his head and viewing the position of the crossbar on the golf swing training aid, whether he is at the proper position at the top of his swing.

The golf swing training aid also helps in using any of the other clubs used in the game. For example, the club may be attached to the grip of a putter to aid in making sure of proper alignment and that the swing is properly executed. Since the crossbar of the golf swing training aid is substantially perpendicular to the face of the club, the crossbar should be pointing at the target. A pointer, clipped on one of the handles can be rotated from a stored position to a pointing position also helps in alignment.

The above and other novel features of the invention can be more fully understood from the following detailed description and the accompanying drawings in which:

DETAILED DESCRIPTION OF THE INVENTION

Figures 1, 2, 3:
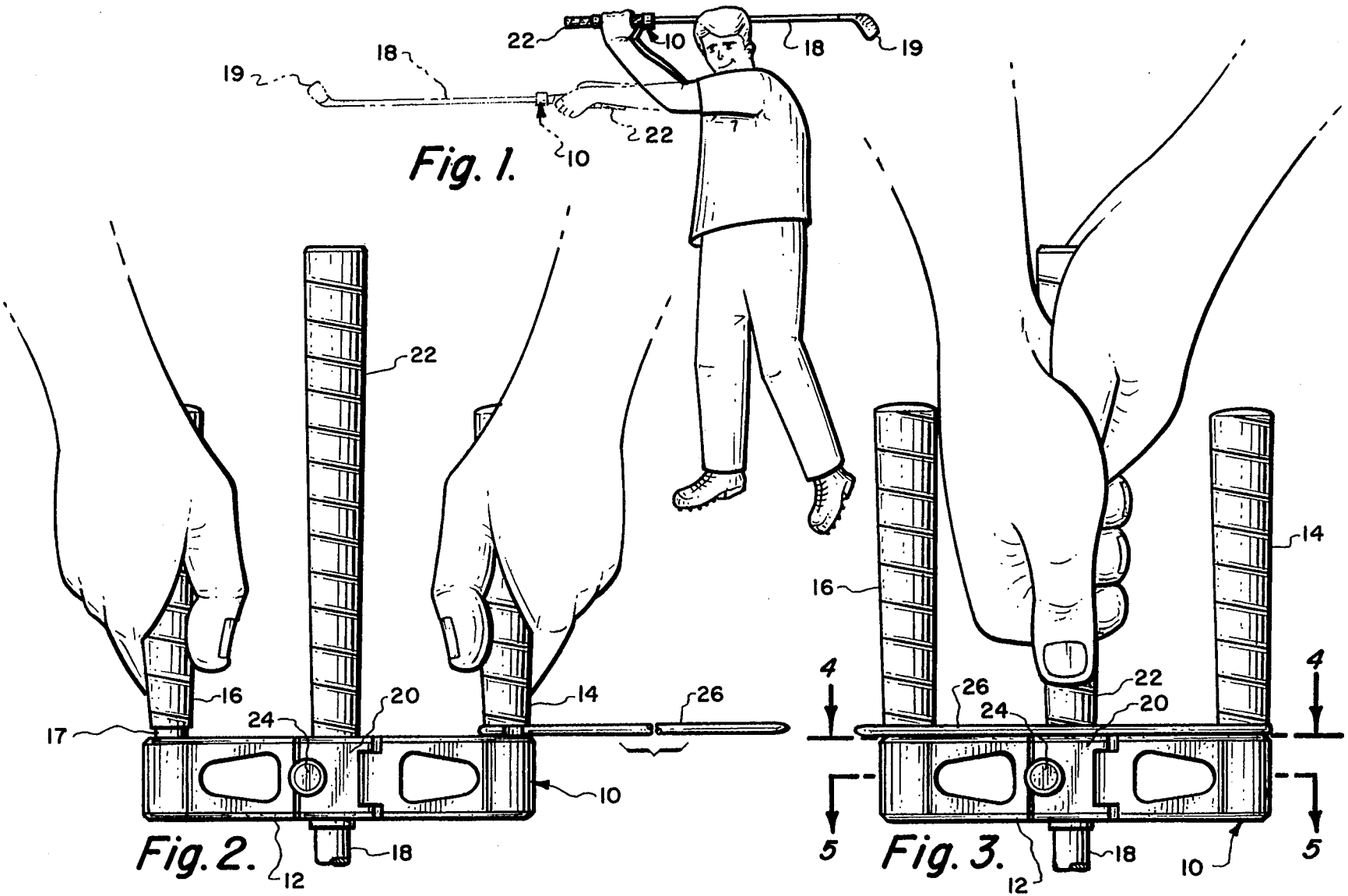
FIG. 1 illustrates the proper use of the golf swing training aid according to the invention.
FIG. 2 is a view illustrating the attachment of the golf swing training aid to a player's own golf club and for teaching this grip.
FIG. 3 illustrates the golf swing training aid attached to a player's golf club with the hands on the golf club grip.

The use of the golf swing training aid, according to the invention is illustrate in FIGS. 1–3. Golf swing training aid 10 is comprised of crossbar 12 having a pair of grips 14 and 16 attached to opposite ends to that they are spaced from the shaft 18 of a golf club. Preferably grips 14 an 16 are at least three inches from golf club shaft 18 for reasons which will become apparent hereinafter. Clamp 20 allows the golf swing training aid to be easily and quickly attached to grip 22 of any one of a player's clubs. Clamp 20 is secured by thumb screw 24 as will be described in greater detail hereinafter. An elongate pointer 26 rotateably snaps into place on the shaft of either grip 14 or 16 for use in aiding in proper alignment.

Figure 4:
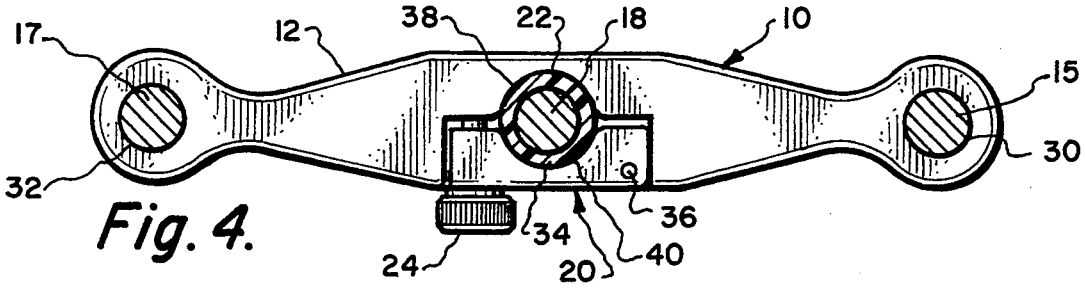
FIG. 4 is a sectional view taken at 4—4 of FIG. 3.
Figure 5:
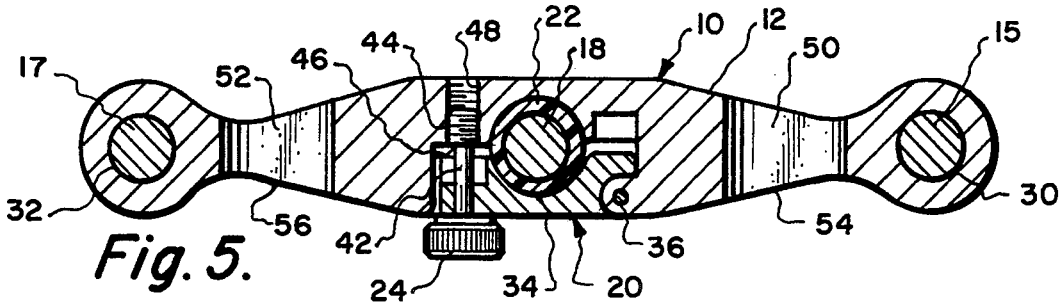
FIG. 5 is a sectional view of the golf swing training aid taken at 5—5 of FIG. 3.

The construction of the golf swing training aid 10 is illustrated in sectional views in FIGS. 4 and 5. Crossbar 12 is preferably constructed of aluminum or stainless steel and has a length that positions grips 14 and 16 sufficiently outboard of golf club grip 22 to allow a player to grip the club while the golf swing training aid is attached. This allows a golfer to switch from a position using the training aid to the grip of the club to get an instant feel for proper use of the club. Shafts 15 and 17 of grips 14 and 16 fit into apertures 30 and 32. Shafts 15 and 17 are preferably secured by an adhesive, but also may be threaded as will be described hereinafter. Clamp 20 is comprised of a plate 34 hinged by pin 36 to crossbar 12. Socket 38 in crossbar 12 mates with a matching groove 40 in plate 34 to securely clamp grip 22 when thumbscrew 24 is tightened down.

Figure 6:
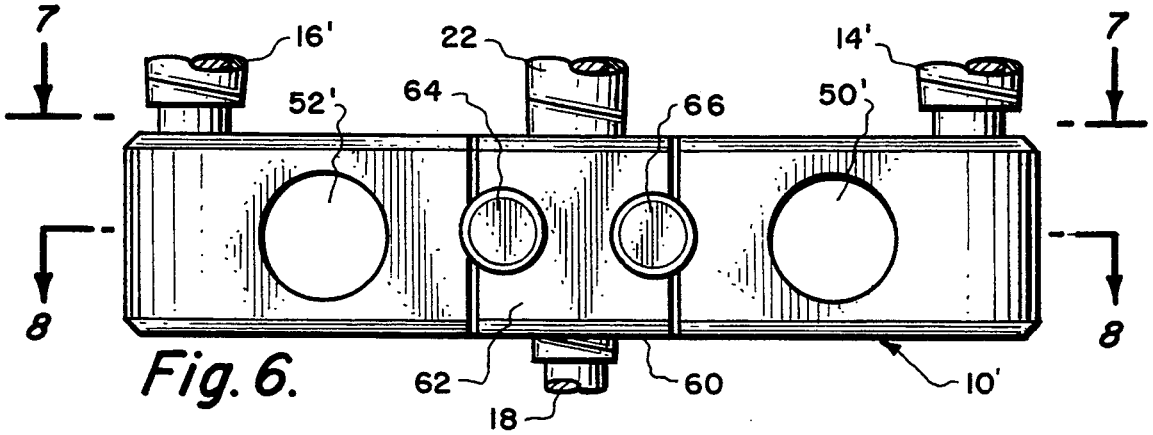
FIG. 6 illustrates an optional embodiment of the golf swing training aid according to the invention.
Figure 7:
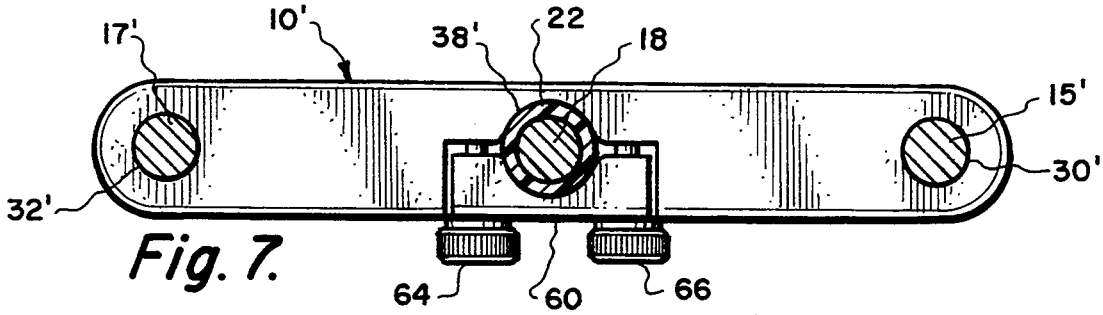
FIG. 7 is a sectional view taken at 7—7 of FIG. 6.
Figure 8:
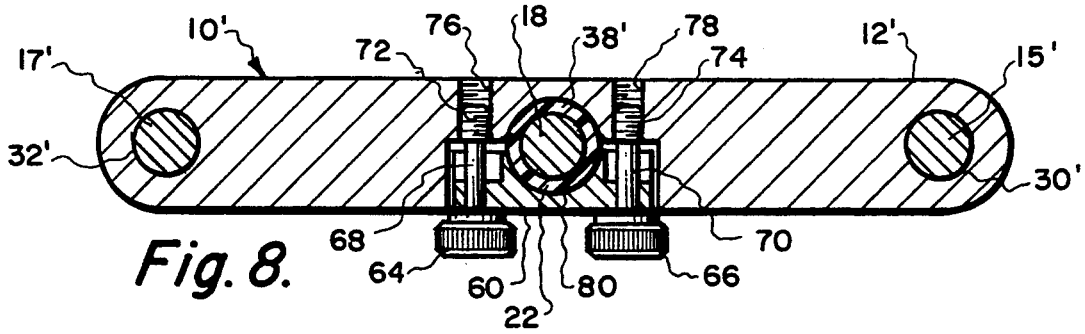
FIG. 8 is a sectional view taken at 8—8 of FIG. 6.

Thumbscrew 24 a captive screw having a shaft 42 and a threaded end 44. This forms a shoulder 46 that prevents thumbscrew from falling out of plate 34 when it is released. Threaded portion 44 threads into threaded aperture 48 in crossbar 12 to securely clamp plate 34 against grip 22. Threaded end 44 is made long enough to accommodate different diameter grips 22. In some cases players use oversized grips when they have large hand or a weak grip to improve the gripping surface. By elongating threaded portion 44 of thumbscrew 24, crossbar 12 can be clamped on substantially all available grips 22. Additionally, the elongated threaded portion 44 makes it easy to thread thumbscrew 24 into threaded aperture 48. Crossbar 12 in the embodiment of FIGS. 4 and 5 has apertures 50 and 52 and tapers at each end 54 and 56 to reduce the overall weight. In an alternate embodiment shown in FIGS. 6–8, crossbar 12 is a straight bar constructed of cast aluminum or stainless steel also having apertures 50' and 52' for weight reduction. However, the bar is uniform in construction across it's length as illustrated in FIGS. 7 and 8. This golf swing training aid will be substantially heavier and will provide the additional benefit of strengthening swing muscles. Grips 14' and 16' are attached as before to each end of the crossbar 12'. That is, shaft 15' and 17' are secured in apertures 30' and 32' either by an adhesive or by threading as will be described in greater detail hereinafter.

In this embodiment, clamp 60 is comprised of a plate 62 and a pair of thumbscrews 64 and 66. Thumbscrews 64 and 66 have shafts 68 and 70 threaded at ends 72 and 74 to engage threaded apertures 76 and 78 in crossbar 12'. This allows uniform tightening of plate 60 on golf club grip 22. The plate 60 may be completely detached from crossbar 12' for attaching the golf swing training aid to golf club grip 22. Golf club grip 22 is positioned in socket 38' in crossbar 12' and plate 60 clamped by tightening thumbscrew 64 and 66 so that groove 80 in plate 60 securely clamps golf grip 22.

Figure 9:
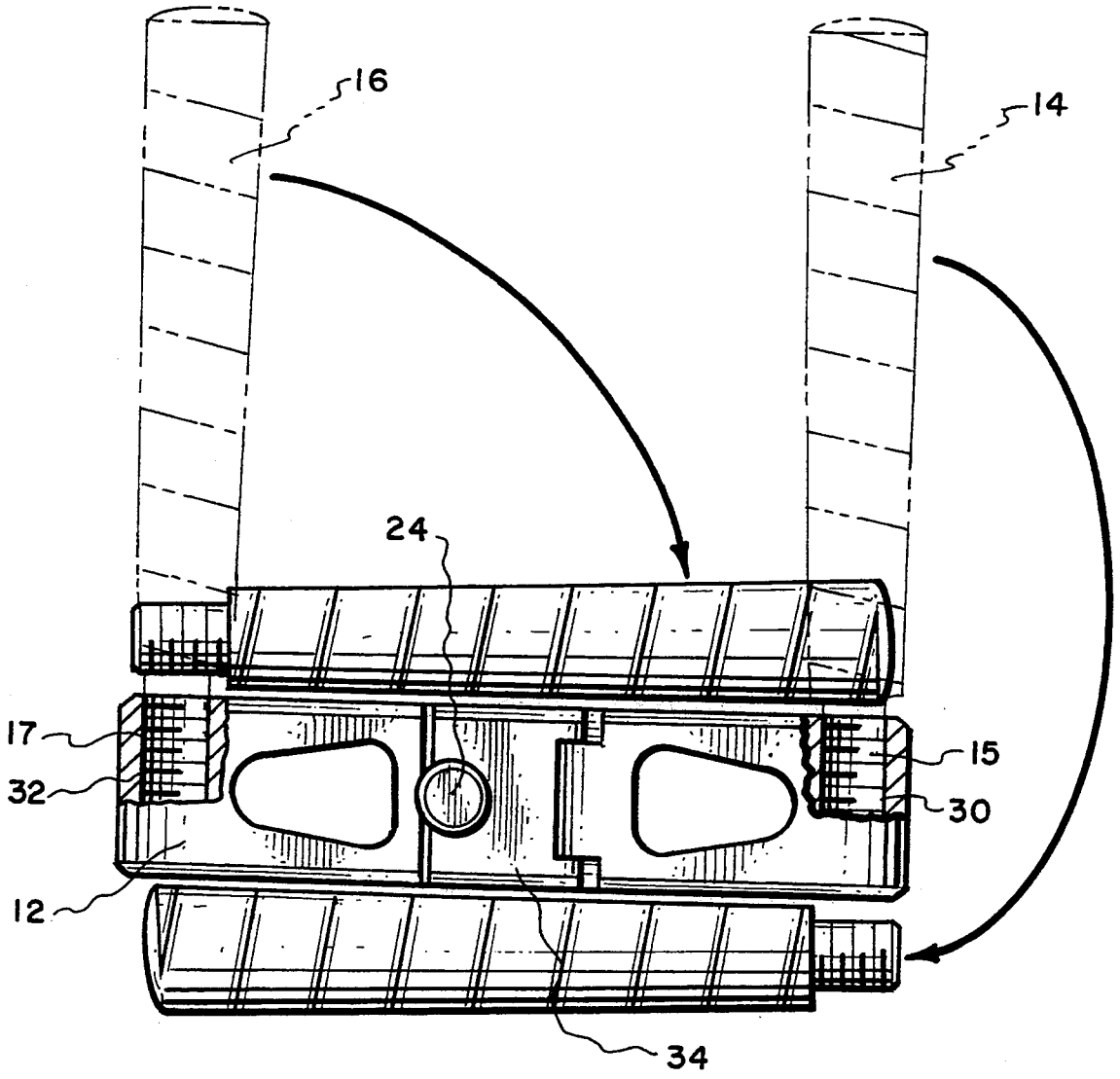
FIG. 9 illustrates a construction of the golf swing training aid according to the invention that allows the grips to be positioned parallel to the crossbar for storage and shipping purposes.

An optional construction is illustrated in FIG. 9 that allows the golf swing training aid to be easily packaged and stored. As shown in this embodiment, grips 14 and 16 have shafts 15 and 17 that are threaded into apertures 30 and 32 so that they may be removed. Optionally, these grips could be hinged so that they fold parallel to crossbar 12. An advantage of this construction is that handles for grips 14 and 16 can be removed and placed parallel to crossbar 12 for storage or shipment. This allows the golf swing training aid to easily be carried in a golf bag. A hinge construction for the golf grip 14 and 16 would allow the golf grips to simply fold down parallel to the crossbar 12.

The golf swing training aid, as described above, can teach almost all aspects of the golf swing from alignment, grip position, swing motion and swing position from driving to putting the player clamps crossbar 12 securely at the bottom of grip 22 substantially parallel to the face of club head 19 illustrated in FIG. 1. As shown in FIG. 1, a player then grips the golf swing training aid substantially, as illustrated in FIG. 2. The position of grips 14 and 16 promote a proper golf grip when used. A proper golf grip requires the palms of the hand to be in opposition as illustrated in FIG. 3. Swinging the club with golf swing training aid 10 securely clamped to club 18 give the player a natural feel for the action of a golf swing. This is similar to the "swing the bucket" routine used by golf instructors. Bringing the club back with the hands on grips 14 and 16 promotes a natural turn during the swing.

As shown in FIG. 1, a proper golf swing requires club head 19 to be pointing upward perpendicular to the ground in mid-swing. This however, is difficult to visualize. With the golf swing training aid securely clamped on grip 22, positive feedback is provided because the player can stop his swing and observe the position of crossbar 12.

At the top of the swing, crossbar 12 should again be substantially parallel to the ground with club head 19 pointing downward perpendicular to the ground. Again, it is difficult for a person to look over his left shoulder to see this position, However, with the golf swing training aid, according to the invention, crossbar 12 can be observed to determine if it is substantially parallel to the ground. Thus the player gets a positive feedback of the proper positioning of the swing as well as a feel for the natural motion that occurs during the swing.

In addition to aiding in the proper positioning and feel of the swing, golf swing training aid 10 can also assist in achieving the proper grip. The position of the two handles 14 an 16 naturally promotes a proper grip. The player can be easily shown the proper grip by gripping the golf swing training aid 10 and then transferring this grip to the club head grip 22 itself. Because grips 14 and 16 are positioned outboard from grip 22 approximately three to four inches, it allows the club 18 to be swung with the golf swing training aid in place. This provides instant and immediate feedback to the player of the proper swing mechanics. The player can first swing the club with the hands on grips 14 and 16 and then swing the club with the hand on grip 22. This action can be repeated until the player gets the proper feel for the golf swing. The weight of the golf swing training aid also helps develop golf swing muscles.

The golf swing training aid 10 can also assist in alignment and putting. With crossbar 12 securely clamped on grip 22, the crossbar should be substantially parallel to the line of the target. That is the crossbar 12 should be pointing toward the target. As a further alignment aid, a pointer 26 clips on shaft 15 or shaft 17 of grips 14 and 16. To aid in alignment, pointer 26 is rotated from a stored position as shown in FIG. 3 to a pointing position as shown in FIG. 2. Pointer 26 can then be aligned parallel to crossbar 12 making it easier to view alignment to the target. This can particularly useful when the golf swing training aid 10 is attached to the grip 22 of a putter.

The motion used when putting is that of a pendulum with the club head swinging through an arc that is as square to the target as possible. With crossbar 12 and pointer 26 pointing directly at the target, the player almost naturally swings the arms in unison to achieve the proper arc. By having the hands spaced apart as shown in FIG. 2, the golf swing training aid discourages using the wrists during the putting stroke. The same applies to pitching and chipping strokes that are similar shots requiring less than a full swing.

Thus, there has been disclosed a golf swing training aid that can provide a player with positive feedback using his own club, of the proper mechanics of the golf swing. The golf swing training aid securely clamps to the grip of the player's own club for teaching all aspects of the golf swing including grip, swing position as well as swing motion. The golf swing training aid can also be used for all types of shots used in the golf game from driving to putting.

This invention is not to be limited by the embodiment shown in the drawings and described in the description which is given by way of example and not of limitation, but only in accordance with the scope of the appended claims.

What is claimed is:

1. A golf club swing training aid for attachment to a standard golf club comprising;

a crossbar;

a pair of golf grips on opposite outboard ends of said crossbar, said golf grips being shorter than a golf grip of said standard golf club;

clamp means coplanar with said pair of golf grips for removably clamping said crossbar to the shaft of said standard golf club so that said pair of grips are equally spaced and on opposite sides and below the grip on said standard club, and said pair of grips and the grip on said standard club are in substantially the same plane;

whereby said golf swing training aid may be quickly and easily attached and detached from the shaft of any standard golf club for teaching a player a proper swing.

2. The swing training aid according to claim 1 wherein said clamp means comprises; a socket in said crossbar for receiving the shaft of said standard golf club; a clamp for securing said shaft in said socket and a thumbscrew for tightening said clamp to secure said crossbar with said grips on the shaft of said standard golf club.

3. The swing training aid according to claim 2 wherein said clamp comprises a plate including a hinge positioned opposite said socket for receiving said golf club shaft; a threaded hole in the side of said plate opposite said hinge; said thumbscrew being captively threaded through said threaded hole in said plate; a second threaded hole in said socket in alignment with said threaded hole in said plate; whereby said captive thumbscrew may be threaded into said second threaded hole to tighten said plate down to securely clamp said shaft of said standard golf club in said socket to firmly secure said golf swing training aid on the shaft of said golf club.

4. The swing training aid according to claim 3 wherein said hinged plate is constructed with a groove corresponding to the socket in said crossbar; said socket and groove being constructed to allow said golf swing training aid to be clamped on a wide range of golf grip diameters on said standard golf clubs.

5. The swing training aid according to claim 4 wherein said golf grips on the outboard ends of said crossbar are approximately two inches shorter than the length of a golf grip on said standard golf club whereby a player may grasp and swing said standard golf club normally with said golf swing training aid attached.

6. The swing training aid according to claim 5 wherein said golf grips on the outboard ends of said crossbar are attached by hinge means to said crossbar whereby they may be folded parallel with said crossbar for storage in a golf bag.

7. The swing training aid according to claim 5 wherein said golf grips on the outboard ends of said crossbar are removably attached so that said golf grips may be removed for storing said golf swing training aid in a golf bag.

8. The swing training aid according to claim 7 wherein said crossbar has threaded holes in opposite ends; said golf grips having threaded ends for removably threading them into said threaded holes.

9. The swing training aid according to claim 5 including pointing means on said golf swing training aid to assist a player using said golf swing training aid in alignment.

10. The swing training aid according to claim 9 wherein said pointing means comprises a rod movably secured to an end of one of said golf grips attached to said crossbar.

11. The swing training aid according to claim 10 in which said pointing means is rotatably attached to an end of one of said golf grips so that it may be rotated out of the way when not in use.

12. The swing training aid according to claim 1 wherein said golf grips on the outboard ends of said crossbar are approximately two inches shorter than the length of a golf grip on said standard golf club whereby a player may grasp and swing said standard golf club normally with said golf swing training aid attached.

13. The swing training aid according to claim 1 wherein said golf grips on the outboard ends of said crossbar are attached by hinge means to said crossbar whereby they may be folded parallel with said crossbar for storage in a golf bag.

14. The swing training aid according to claim 1 wherein said golf grips on the outboard ends of said crossbar are removably attached so that said golf grips may be removed for storing said golf swing training aid in a golf bag.

15. The swing training aid according to claim 14 wherein said crossbar has threaded holes in opposite ends; said golf grips having threaded ends for removably threading them into said threaded holes.

16. The swing training aid according to claim 1 including pointing means on said golf swing training aid to assist a player using said golf swing training aid in alignment.

17. The swing training aid according to claim 16 wherein said pointing means comprises a rod movably secured to an end of one of said golf grips attached to said crossbar.

18. The swing training aid according to claim 17 in which said pointing means is rotatably attached to an end of one of said golf grips so that it may be rotated out of the way when not in use.

* * * * *